United States Patent [19]

Nasu et al.

[11] 4,442,596

[45] Apr. 17, 1984

[54] CASING OF A WASHABLE ELECTRIC APPLIANCE

[75] Inventors: Sataroh Nasu; Kouichi Iwanaga; Hiroshi Kikuchi, all of Osaka, Japan

[73] Assignee: Matsushita Electric Works, Ltd., Osaka, Japan

[21] Appl. No.: 380,428

[22] Filed: May 20, 1982

[30] Foreign Application Priority Data

Jun. 29, 1981 [JP] Japan ..... 56-101819

[51] Int. Cl.[3] ..... B26B 19/38

[52] U.S. Cl. ..... 30/41.5; 30/41

[58] Field of Search ..... 30/41.5, 41, 32, 41.6, 30/85

[56] References Cited

U.S. PATENT DOCUMENTS

| | | | |
|---|---|---|---|
| 2,632,242 | 3/1953 | Musso | 30/41 |
| 3,311,975 | 4/1967 | Longuyon | 30/85 X |
| 3,369,294 | 2/1968 | Shaw | 30/41.5 |
| 3,736,243 | 5/1973 | Duggan | 30/32 X |

*Primary Examiner*—Jimmy C. Peters

*Attorney, Agent, or Firm*—Koda and Androlia

[57] ABSTRACT

A casing for an electric appliance provided on its outer surface with a plurality of minute tapered projections which are of 15 to 30 microns in height and bottom diameter whereby a minute projections shed the water wetting the body resulting in the water not having a bad effect upon the electric appliance.

3 Claims, 6 Drawing Figures

CASING OF A WASHABLE ELECTRIC APPLIANCE

BACKGROUND OF THE INVENTION

1. Field of the Invention

The present invention relates to washable electric appliances and more particularly to a casing for a washable electric appliance.

2. Prior Art

Casing for electric devices is frequently made from a synthetic resin plastic or a metallic material. Such casing has a drawback that when the casing gets wet with water, the water, remaining thereon after the device or appliance has been shaken to remove the water, spreads out on the surface of the casing and in some cases flows into the electrical portions of the device of appliance causing a short circuit problem. Furthermore, a wet device or appliance tends to slip out of the user's hand while being used. To prevent the device or appliance from slipping out of the user's hand, a casing with a plurality of projections on its surface has been proposed so that the casing may snugly fit the user's fingers or hands and such projections have been designed to be large to perform their function and have no effect on the removable of the remaining water. In addition, an electric shaver of the type which the waste hair may be washed away with water has another imperfection in that the user may be bothered by a foul smell. That is, the shaved off waste hair is likely to be mixed with particles of skin and fatty substances shaved away together with the hairs which is cohesive, corrosive and apt to solidify; therefore, if water remains in the waste hair receptacle on the shaver, bacteria grow in the waste with the aid of remaining water and the waste incrust the inner surface of the receptacle thereby emitting a foul smell and producing an unsanitary condition.

SUMMARY OF THE INVENTION

Accordingly, it is the primary object of the present invention to provide a casing for an electrical device or appliance in which the drops of liquid such as water on the surface of the instrument may be easily removed by forming the drops into small ball-like shapes to roll down therefrom.

It is another object of the present invention to provide a casing for an electrical device or appliance wherein the casing does not become slippery in the users hand when wet.

It is yet another object of the present invention to provide a casing for an electrical device or appliance wherein the casing dries quickly and water is prevented from entering an interior of the casing to prevent malfunctions.

In keeping with the principles of the present invention, the objects of this invention are accomplished by a unique structure for a casing of an electric appliance on which the surface is provided with the plurality of minute tapered projections that have a large amount of contact angle with a water drop on the projections to remove the water drops.

BRIEF DESCRIPTION OF THE DRAWINGS

The above-mentioned features and objects of the present invention will become more apparent with reference to the following description taken in conjunction with the accompanying drawings, wherein like reference numerals denote like elements and in which.

DETAILED DESCRIPTION OF THE INVENTION

Figure 1:
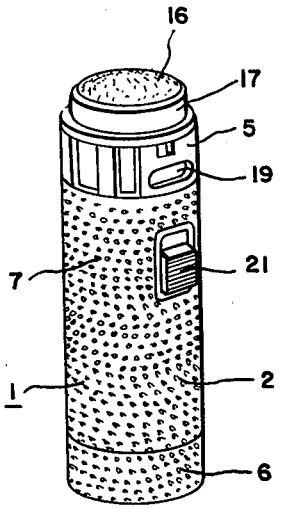
FIG. 1 is a perspective view of an external appearance of an electrical appliance such as a shaver in accordance with the teachings of the present invention.
Figure 2:
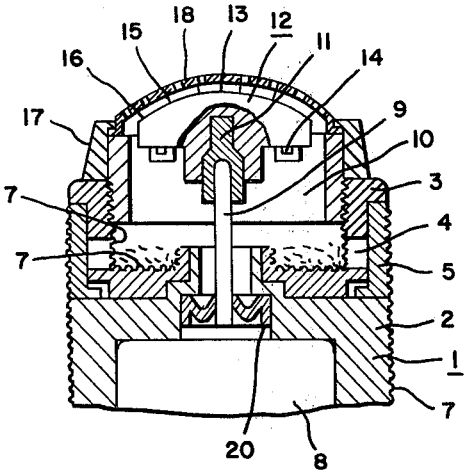
FIG. 2 is a sectional view of the main part of FIG. 1.

The present invention will be described by way of an embodiment thereof in the form of an electric shaver whose shaving blades are washable in water. Referring more particularly to the drawings, electric shaver includes a casing 1 formed of a synthetic resin plastic material and which comprises a generally cylindrical main body case 2, an outer body mounting base 3 fixed to the top end of the main body case 2, an annular lid 5 provided on the outside of the outer blade mounting base 3 for opening and closing an opening 4 formed on the outer blade mounting base 3 and a bottom cover 6 detachably fixed to an edge of a bottom opening of the main body case 2. A plurality of minute, truncated conical projections 7 are arranged on the outer surface of the casing 1 and on the inner surface of the mounting base 3 in a matrix pattern. The projections 7 are of, for example, 15 to 30 microns in height and bottom diameter and the space between adjacent projections 7 is further set at 15 to 30 microns from the top ends thereof. A motor 8 and a battery (both not illustrated) are contained in the main body case 2. A drive shaft 9 of the motor 8 protrudes into a waste hair receptacle 10 whose bottom is formed by the outer blade of the mounting base 3, and an inner blade 12 is detachably fixed to the free end of the output shaft 9 through a joint 11. The inner blade block 12 is composed of an inner blade base 13 formed of a synthetic resin plastic material, a metallic push-up spring 14 fixedly secured to the inner blade base 13 and metallic inner blades 15 vertically and movably supported by the push-up spring 14. An outer blade 16, screwed into the outer blade mounting base 3 by way of an outer blade base 17, is arranged to cut the hairs which enter through the perforations 18 provided on the outer blade 16 in cooperation with the inner blades 15 and the hairs shaved or cut off are captured in the waste hair receptacle 10.

Figure 3:
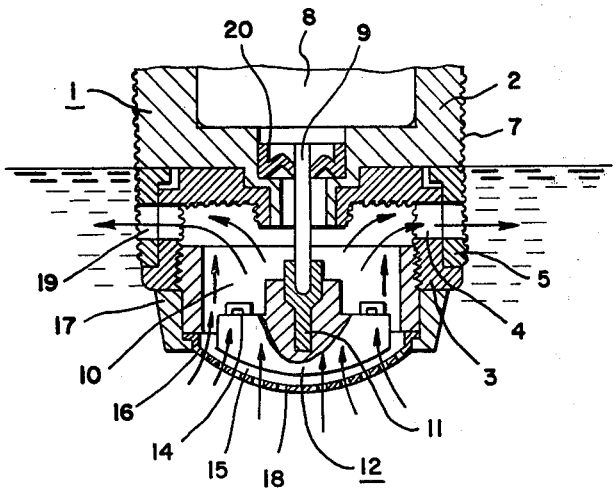
FIG. 3 is a sectional view showing how to remove waste hair with water in the appliance of FIG. 1.
Figure 4:
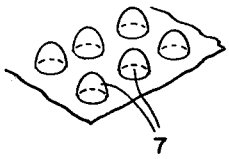
FIG. 4 is an enlarged view of a minute projection utilized in the present invention.

The annular lid 5 for opening and closing an opening 4 of the outer blade mounting base 3 is also provided with an opening 19; and both openings 4 and 19 are brought into an agreement with each other when the annular lid 5 is turned as shown in FIG. 3 so that the waste hair receptacle 10 may be opened from the outside. When the shaver is turned upside down and the outer and inner blades 15 and 16 are dipped into water and the inner blade block 12 is driven, a current of water is generated in the waste hair receptacle 10 and the waste hair captured therein and struck to the inner blade block 12 and the outer blade 16 are flushed to the outside. A water-tight ring 20 is provided to abut not only its outer periphery against the main body case 2 but also its inner periphery against the output shaft 9 of the motor 8 to prevent water from entering into the motor 8. The electric shaver further includes a switch 21 for the power source.

Figure 5:
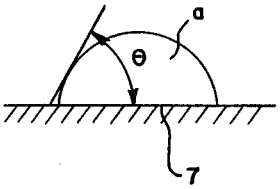
FIG. 5 is a view of a liquid drop on a surface showing the contact angle $\theta$ between the surface and the liquid drop.

Minute projections are preferably made of a material which is able to provide a large degree of contact angle $\theta$ with a liquid (see FIG. 5), for example, fluororesin, so as to make a liquid drop remaining on the projections form into a small ball-like shape. In forming minute projections on synthetic resin or metallic material, use of a metallic mold in which minute recesses are provided by etching is preferable. Furthermore, if the casing is made from a material which does not provide a sufficient contact angle $\theta$, another way to obtain the projections 7 with a sufficient degree of contact angle $\theta$ by performing the projections on a sheet of material which provides a large contact angle $\theta$ and sticking it to the surface of the parts of the electric shaver, or spraying a liquid resin which has a large contact angle $\theta$ onto parts on which the minute projections are performed.

Figure 6:
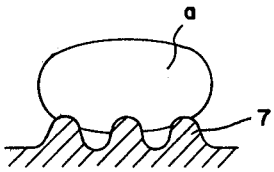
FIG. 6 is a view illustrating a liquid drop on the projections of the present invention.

The contact angle $\theta$ is an indicator of the wettability of the material or the amount the liquid drop a spreads out over the material. The drop a remaining on a solid body can be deemed to be a part of a sphere if the magnitude of the gravity acting on the drop is so small as to be negligible. Therefore, assuming a height and a bottom diameter of a drop as h and x, respectively, the contact angle $\theta$ can be shown by the equation $\theta=2\cdot\tan^{-1}(h/x)$. A liquid drop a, remaining on a surface having minute projections formed of a material providing a large contact angle $\theta$, rides on the projections due to the surface tension thereof as shown in FIG. 6. When the surface of the casing is inclined, even slightly, the drop a rolls smoothly down from one projection to the other in turn just lke a drop on a lotus leaf does. Thus, an improved water removal function is obtained, causing quick drying of the appliance or device. The size of the minute projections for optimum water removal function and the distance between the tops of projections vary somewhat according to the viscosity coefficient of the liquid and the wettability of the material. For water, an arrangement of truncated concial minute projections which are 15 to 30 microns in height and at the bottom diameter and provided in a matrix pattern at 15 to 30 microns intervals lead to the best results.

Thus, an electric shaver which may wash the hair waste away with water and is provided on its casing surface with tapered minute projections is so excellent in its water removal function that almost all of the water may be taken off by merely shaking the shaver body, thereby preventing emission of a foul smell caused by the growth of bacteria even when a small amount of waste hair remains in the receptacle.

As described above, a casing for an electrical device or appliance according to the present invention is characterized in that a multiplicity of tapered minute projections are provided on the surface thereof; therefore, the casing exhibits superior effects in preventing water from flowing into the electrical part, because almost all of the remaining water may be removed by shaking the appliance or device. Furthermore, providing a multiplicity of minute projections may provide a comfortable fit with the user's hand to prevent the appliance or device from slipping from the user's hand due to water on the case.

It should be apparent to those skilled in the art that the above-described embodiment is merely illustrative of but one of the many possible specific embodiments which represents the application of the principles of the present invention. Numerous and varied other arrangements can be readily devised by those skilled in the art without departing from the spirit and scope of the invention.

We claim:

1. A casing for an electric appliance characterized in that a plurality of tapered minute projections are formed on the surface thereof, said minute projections being 15–30 microns in height and 15–30 microns in bottom diameter and being arranged in intervals of 15–30 microns from each other.

2. A casing for an electric appliance according to claim 1, wherein said minute projections are arranged in a matrix pattern.

3. A casing for an electric appliance according to claim 1, wherein said minute projections are formed of a synthetic resin plastic material which provides a large degree of contact angle between itself and a liquid.

* * * * *